US006457736B1

(12) United States Patent
Maravetz et al.

(10) Patent No.: US 6,457,736 B1
(45) Date of Patent: Oct. 1, 2002

(54) ACTIVE HIGHBACK SYSTEM FOR A SNOWBOARD BOOT

(75) Inventors: Paul T. Maravetz, Morristown; David J. Dodge, Williston; Franklin S. Phillips, Richmond; Steven C. McDonald, Herber; James D. Laughlin, Burlington, all of VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/603,370

(22) Filed: Jun. 26, 2000

Related U.S. Application Data

(63) Continuation of application No. 09/403,188, filed as application No. PCT/US98/07883 on Apr. 17, 1998, now abandoned.

(60) Provisional application No. 60/044,716, filed on Apr. 18, 1997.

(51) Int. Cl.[7] ..... A63C 9/00

(52) U.S. Cl. ..... 280/624; 280/634; 280/11.36

(58) Field of Search ..... 280/11.3, 11.34, 280/11.36, 14.21, 14.22, 624, 625, 633, 634; 36/118.2, 118.4, 89

(56) References Cited

U.S. PATENT DOCUMENTS

| | | | | | |
|---|---|---|---|---|---|
| 5,031,341 | A | * | 7/1991 | Paris et al. | 36/118.2 |
| 5,435,080 | A | | 7/1995 | Meiselman | |
| 5,517,771 | A | * | 5/1996 | Paris et al. | 36/118.2 |
| 5,664,344 | A | * | 9/1997 | Marmonier | 36/118.2 |
| 5,727,797 | A | * | 3/1998 | Bowles | 280/14.21 |
| 5,815,952 | A | | 10/1998 | Bobrowicz | |
| 5,899,483 | A | | 5/1999 | Paris | |
| 5,901,971 | A | * | 5/1999 | Eaton | 280/624 |
| 5,997,097 | A | | 12/1999 | Jungkind | |
| 6,003,893 | A | | 12/1999 | Hansen | |
| 6,007,077 | A | | 12/1999 | Moe | |
| 6,076,287 | A | * | 6/2000 | Savard | 36/118.2 |
| 6,101,745 | A | | 8/2000 | Grandin et al. | |
| 6,116,634 | A | | 9/2000 | Mometti | |
| 6,126,179 | A | * | 10/2000 | Dodge | 280/624 |
| 6,231,066 | B1 | | 5/2001 | Okajima | |
| 6,283,492 | B1 | * | 9/2001 | Hale | 280/11.36 |
| 6,325,405 | B2 | | 12/2001 | Okajima | |

FOREIGN PATENT DOCUMENTS

| | | | | |
|---|---|---|---|---|
| DE | 4237919 | * | 5/1993 | 36/118.2 |
| EP | 0740908 B1 | | 11/1996 | |
| EP | 0753269 B1 | | 1/1997 | |
| FR | 2732230 | | 10/1996 | |
| FR | 2754462 | | 4/1998 | |
| FR | 2760373 | | 9/1998 | |
| WO | 86/03984 | * | 7/1986 | 280/11.36 |
| WO | 94/27455 | * | 12/1994 | 36/118.2 |

* cited by examiner

*Primary Examiner*—Frank Vanaman
(74) *Attorney, Agent, or Firm*—Wolf, Greenfield & Sacks, P.C.

(57) ABSTRACT

A system is provided for automatically activating a boot-mountable highback between a walk mode and a ride position. In the walk mode, the highback is unrestrained, permitting the boot to flex freely, and consequently allowing the rider to walk comfortably. In the ride position, the highback is tilted toward the toe portion of a boot and prevented from movement in the heel direction beyond a preselected forward lean position, so that leg movement in the heel direction is transmitted through the highback into a gliding board. The highback is adjusted between the walk mode and the ride position simply by stepping into or out of a binding attached to a snowboard. Activation and deactivation of the highback may be achieved through direct or indirect interaction with a board-mounted actuator that may be attached to the binding. A forward lean adjuster may be provided that allows a rider to preselect the amount of forward lean attained when the highback is activated into the ride position.

63 Claims, 9 Drawing Sheets

ACTIVE HIGHBACK SYSTEM FOR A SNOWBOARD BOOT

This application is a continuation of Serial No. 09/403,188, filed Oct. 18, 1999, now ABN., which is a 371 of PCT/US98/07883 filed Apr. 17, 1998, which also claims benefit to Provisional Application Serial No. 60/044,716 filed Apr. 18, 1997.

BACKGROUND OF THE INVENTION

1. Field of the Invention

The present invention relates generally to the field of boots and bindings for gliding sports and, more particularly, to the field of snowboard boots and bindings.

2. Description of the Related Art

Specially configured boards for gliding along a terrain are known, such as snowboards, snow skis, water skis, wake boards, surf boards and the like. For purposes of this patent, "gliding board" will refer generally to any of the foregoing boards as well as to other board-type devices which allow a rider to traverse a surface. For ease of understanding, however, and without limiting the scope of the invention, the inventive active highback to which this patent is addressed is disclosed below particularly in connection with an active highback for a soft snowboard boot that is used in conjunction with a snowboard. It should be appreciated, however, that the present invention described below can be used in association with other types of gliding boards, as well as other types of boots, such as hybrid boots.

Snowboard binding systems for soft snowboard boots typically include an upright member, called a "highback" that helps transmit forces directly to and from the board, allowing the rider to efficiently control the board through leg movement. For example, flexing one's legs rearward against the highback places the board on its heel edge with a corresponding shift in weight and balance acting through the highback to complete a heel side turn.

Snowboard binding systems used with soft snowboard boots are generally classified as either tray bindings or step-in bindings. In a tray binding, the highback is traditionally mounted to the tray or baseplate of the binding, and one or more straps extend across and secure the boot to the binding. The highback abuts a heel hoop of the binding tray so that forces applied through the boot to the highback are transmitted through the tray into the board. The rider typically wears snowboard boots that are flexible and very comfortable for walking once removed from the binding. Additionally, tray bindings allow the rider's foot to roll laterally when riding, a characteristic desired by many riders.

In a step-in binding, the highback may be mounted either to or within the boot or upon the binding. One or more strapless engagement members grasp and lock the boot to the board when the rider steps into the binding. While convenient in terms of locking and releasing a boot, a step-in boot typically employs a more rigid shell and sole structure, making the boot rather stiff and uncomfortable for walking.

A snowboard rider's legs are generally held by the highback at a forward angle relative to the board for balance, control and to ensure the rider's knees are bent to better absorb shock, particularly when landing jumps. To hold the rider's legs in such a stance, the highback is typically inclined relative to the board in a position referred to as "forward lean". The particular forward lean angle of the highback relative to the board may be selectively adjusted by the rider for comfort, control and one's particular riding style.

When mounted to the binding, the forward lean of the highback may be either preset prior to or adjusted after the rider steps into the binding. For a preset highback, an extreme forward lean angle can hinder insertion and proper positioning of the boot in the binding. For a boot-mounted highback, a locked forward lean position may render the boot awkward and very uncomfortable for walking. To address this concern, some boot-mounted highbacks include a manually operated locking mechanism that allows the rider to move the highback into a stiff configuration for riding and a relaxed arrangement for walking. A rider may consider manual activation and deactivation inconvenient.

In view of the foregoing, it is an object of the present invention to provide an improved system for activating a highback between a ride position and a walk mode.

SUMMARY OF THE INVENTION

In one illustrative embodiment of the invention, a snowboard boot is provided comprising a snowboard boot body including a toe portion, a heel portion and a leg portion, and an active highback supported on the snowboard boot body about the leg portion to provide heel side support. The leg portion is flexible relative to the toe and heel portions in a toe direction and a heel direction. The highback is engagable with a forward lean actuator that is separate from the snowboard boot to automatically activate the highback into a ride position at a predetermined forward lean, where the highback is tilted toward the toe portion of the boot to prevent movement of the leg portion in the heel direction beyond the predetermined forward lean so that leg movement in the heel direction is transmitted through the highback into a snowboard. The highback is deactivated from the ride position to assume a walk mode when the highback is not engaged with the forward lean actuator, where the highback is unrestrained so that the leg portion of the boot is permitted to flex in the heel direction beyond the predetermined forward lean.

In another illustrative embodiment of the invention, an apparatus is provided comprising a forward lean actuator that is constructed and arranged to be mounted on a gliding board, and a separate boot-mountable highback. The highback is to be activated by the forward lean actuator into a ride position at a predetermined forward lean, where the highback is tilted toward a toe portion of the boot and prevented from movement in a heel direction beyond the predetermined forward lean so that leg movement in the heel direction is transmitted through the highback into the gliding board. The highback is to be deactivated from the ride position to assume a walk mode when the boot is detached from the gliding board, where the highback is unrestrained so that the boot is permitted to flex in the heel direction beyond the predetermined forward lean.

In a further illustrative embodiment of the invention, an apparatus is provided comprising a snowboard boot, a highback mounted to the snowboard boot, a snowboard binding to secure the snowboard boot to a snowboard, and a forward lean actuator mounted to the snowboard binding. The highback is activated by the forward lean actuator into a ride position at a predetermined forward lean when the snowboard boot is secured in the snowboard binding, where the highback is tilted toward a toe portion of the boot and prevented from movement in a heel direction beyond the predetermined forward lean so that leg movement in the heel direction is transmitted through the highback into the snowboard. The highback is to be deactivated from the ride position to assume a walk mode when the boot is detached from the binding, where the highback is unrestrained so that the boot is permitted to flex in the heel direction beyond the predetermined forward lean.

In yet another illustrative embodiment of the invention, a method is provided for activating a highback between a ride position and a walk mode. The method comprising steps of (a) providing a boot with a highback; (b) providing a forward lean actuator on a gliding board separate from the boot; and(c) activating the highback with the forward lean actuator into the ride position at a predetermined forward lean by placing the boot on the gliding board, where the highback is tilted toward a toe portion of the boot and prevented from movement in a heel direction beyond the predetermined forward lean so that leg movement in the heel direction is transmitted through the highback into the gliding board.

BRIEF DESCRIPTION OF THE DRAWINGS

The invention will be appreciated more fully with reference to the following detailed description of illustrative embodiments thereof, when taken in conjunction with the accompanying drawings, wherein like reference characters denote like features, in which.

DETAILED DESCRIPTION

The present invention is directed to a method and a system for automatically activating a highback between a walk mode and a ride position. In the walk mode, the highback is unrestrained, permitting the boot to flex freely, and consequently allowing the rider to walk comfortably. In the ride position, the highback is tilted toward the toe portion of a boot and prevented from movement in the heel direction beyond a preselected forward lean position, so that leg movement in the heel direction is transmitted through the highback into a gliding board.

Figure 1:
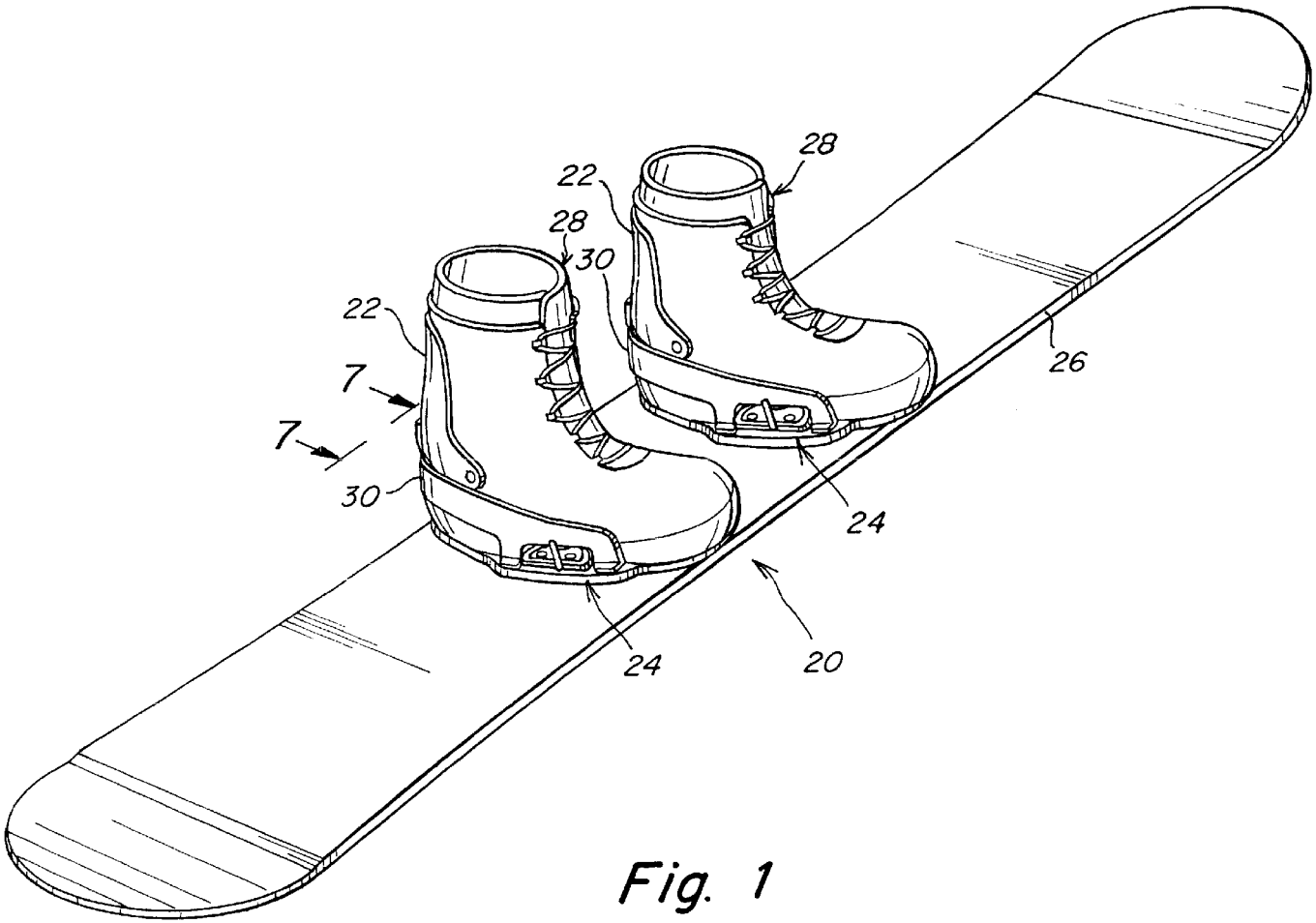
FIG. 1 is a perspective view of the active highback system according to one embodiment of the invention implemented with snowboard boots and bindings mounted to a snowboard.

In one illustrative embodiment as shown in FIG. 1, the system 20 includes a highback 22 that may be adjusted between a walk mode and a ride position simply by stepping into or out of a binding 24 that is attached to a snowboard 26 or other gliding board, such as a ski or the like. For example, when stepping into the binding 24, the highback 22 is activated into the forward lean ride position. Conversely, when removed from the binding 24, the highback 22 is deactivated from its forward lean position so that the snowboard boot 28 may be readily flexed without requiring the rider to manually release the forward lean of the highback. Accordingly, the system includes an active highback 22 that conveniently eliminates manual activation of a locking mechanism between the snowboard boot 28 and highback 22, allowing the highback, and consequently the boot, to be quickly and easily transformed between the walk and ride modes.

Figure 2A:
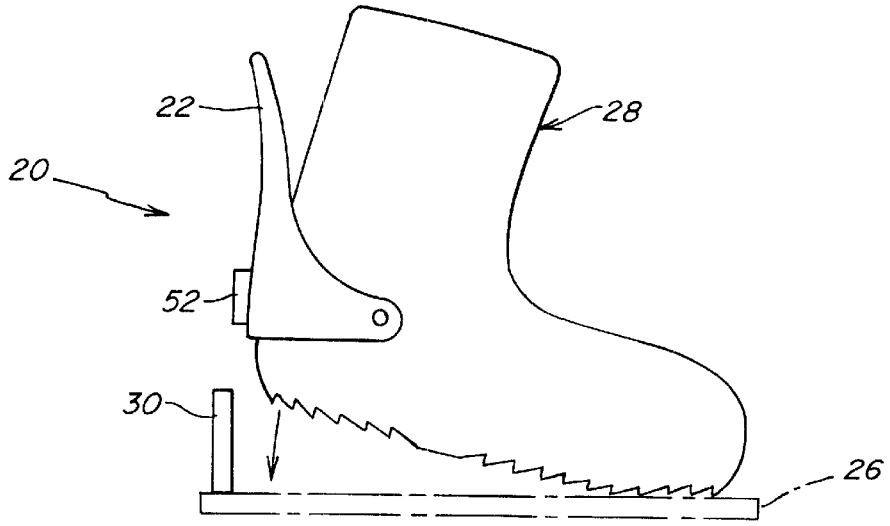
FIGS. 2A–2C schematically illustrate the operation of the active highback system according to one embodiment of the present invention.
Figure 2B:
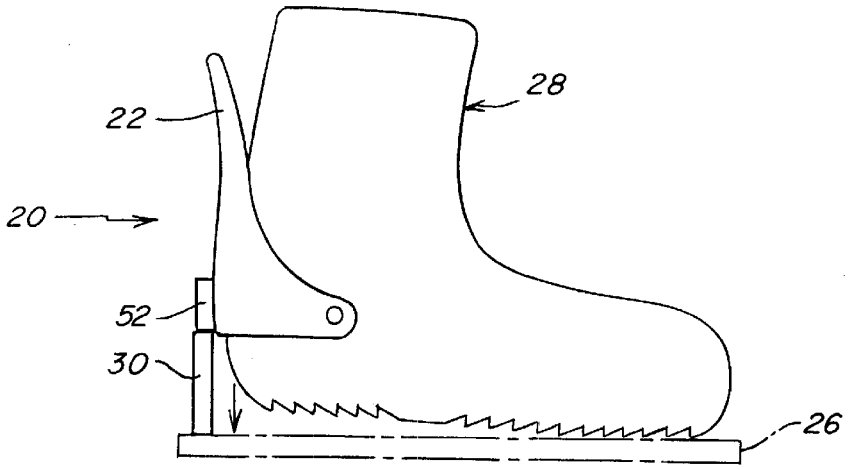
Figure 2C:
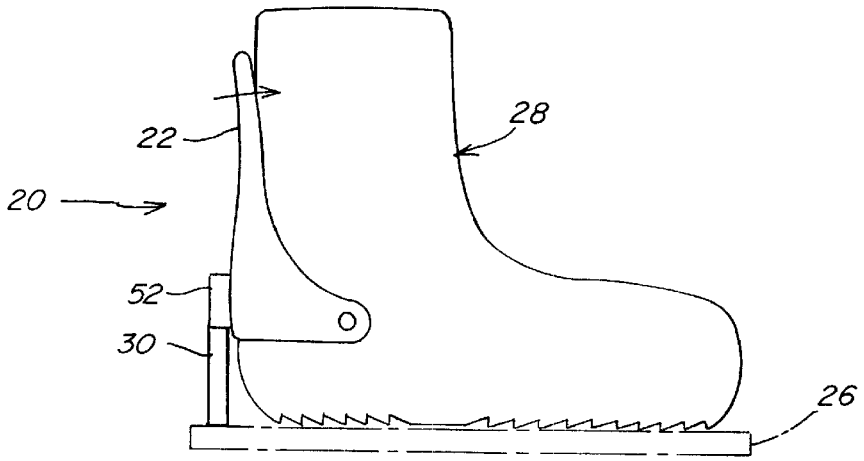

Activation and deactivation of the highback forward lean may be readily achieved with one embodiment of a system 20 that includes a highback 22 arranged to interact with a board-mounted actuator 30, as schematically illustrated in FIGS. 2A–2C. To activate the highback 22, the rider simply seats the boot 28 in the binding (not shown), which may be a step-in binding, a tray binding or any other suitable binding. As the boot 28 is being secured in the binding (FIG. 2B), a lower portion of the highback 22 engages the actuator 30. As the boot 28 becomes fully seated (FIG. 2C), the highback 22 is driven toward the boot 28 and the forward lean position. When the boot 28 is released from the binding, the highback 22 assumes a walk mode that allows the boot to be easily flexed.

While eliminating manual actuation of a locking mechanism to achieve a comfortable and natural walk mode, this system also allows a rider to step into the binding with her leg initially positioned generally vertical, rather than angled, relative to the board. This advantageously allows the rider to generate a high downward force for actuating the binding, such as a step-in binding, and for driving the highback 22 toward the forward lean ride position.

Figure 3:
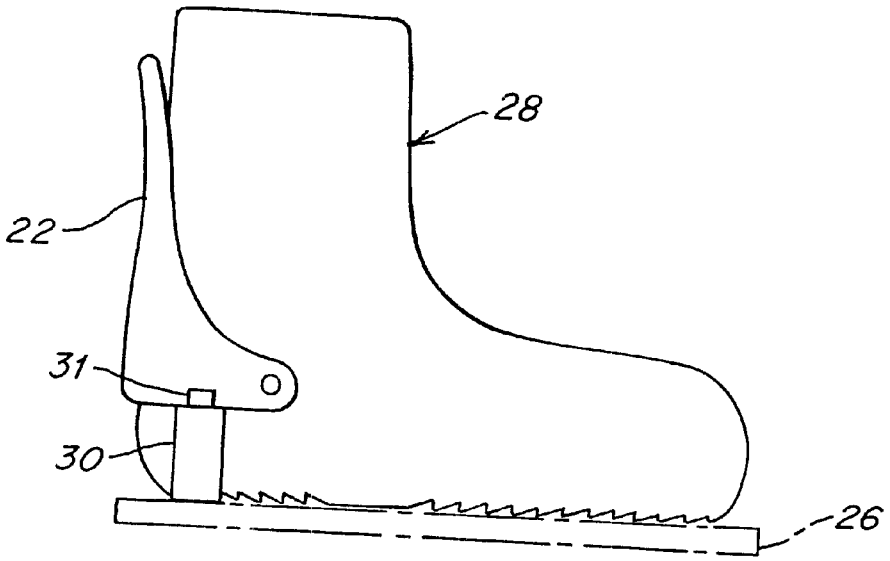
FIG. 3 is a schematic side view of the active highback system illustrating an alternate actuator configuration.
Figure 4:
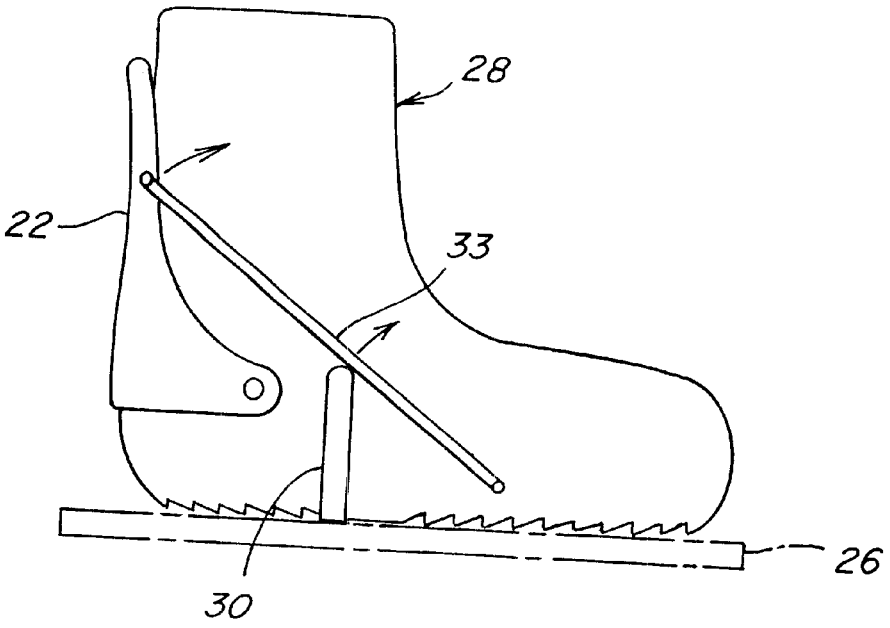
FIG. 4 is a schematic side view of the active highback system illustrating an indirect actuator configuration.

Although the system has been illustrated with the actuator 30 disposed at the rear of the boot 28, it is to be understood that the actuator may be positioned in any suitable location relative to the highback 22 as would be appreciated by one of skill in the art. For example, as illustrated in FIG. 3, the actuator 30 may be located adjacent one or both sides of the boot 28 so that a portion 31 of one or both lateral sides of the highback 22 engage the actuator. The system may also be configured so that the highback 22 is activated either through direct contact with the actuator 30, as described above, or through indirect contact with the actuator. For example, as illustrated in FIG. 4, the system may include a link 33, such as a cable or strap, that interconnects the upper portion of the highback 22 to a forward portion of the boot 28. As the boot is seated in the binding (not shown), the actuator 30 engages and deflects the link 33 driving the highback 22 toward the forward lean ride position.

As described more fully below, the active highback 22 may be mounted either directly or indirectly to the boot 28 to accommodate various binding systems. The highback 22 may be either permanently attached to or removable from the boot 28. A removable highback provides system flexibility by allowing the boot to be implemented with binding systems that already include a highback mounted to a binding baseplate. The highback may be either externally or internally mounted to the boot.

Figure 5:
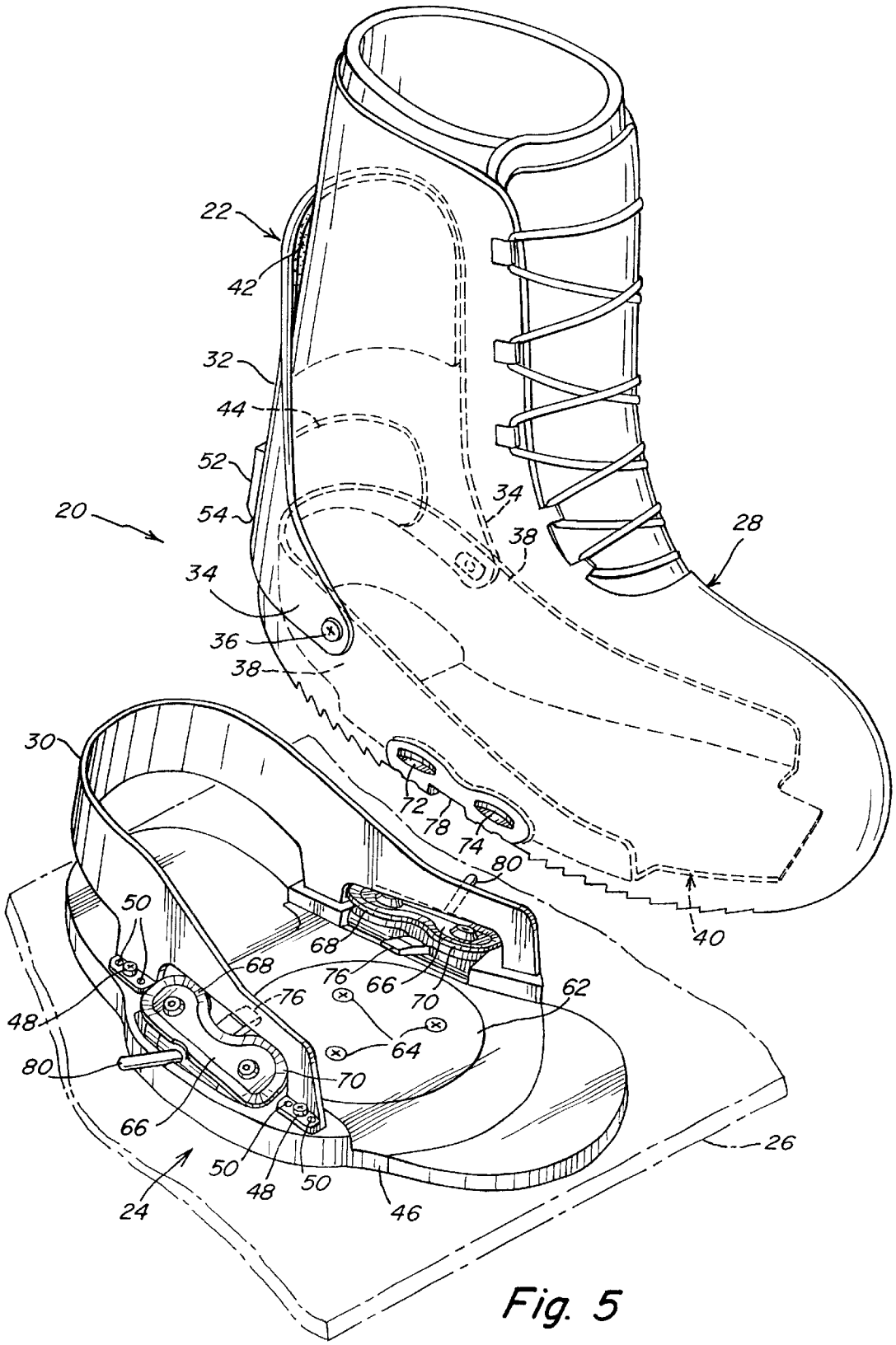
FIG. 5 is a perspective view of the active highback and step-in binding system according to one illustrative embodiment of the invention.

In one illustrative embodiment of the invention shown in FIG. 5, a highback 22 is movably mounted to the heel region of the boot 28. As illustrated, the highback 22 includes an elongated back member 32 and a pair of lateral arms 34 that extend from the sides of the back member 32 toward the toe portion of the boot 28 adjacent opposite sides of the heel portion. The lateral arms 34 are preferably attached below the ankle portion of the boot for facilitating lateral or side-to-side boot flexibility that allows desired lateral foot roll. The lateral arms 34 may be attached to the boot 28 using any suitable fastener 36, such as a screw, rivet or the like, that passes through each lateral arm.

The attachment points on the boot 22 are preferably reinforced to ensure that the interconnection can withstand the loads applied through the highback and boot. In one illustrative embodiment, the highback 22 is attached to the sidewalls 38 of a binding interface 40 that is built into the boot 28. The sidewalls 38 of the interface 40 preferably have a height (e.g., not to exceed approximately three inches) that is sufficiently low to terminate below the rider's ankle to ensure that the sidewalls 38 do not inhibit lateral bending of the ankle.

The highback 22 is preferably molded from a rigid plastic material (e.g., polycarbonate, polyolefin, polyurethane, polyethylene and the like) in a shape that is compatible with the contour of the boot 28, providing several advantages. For example, force transmission is increased between the highback and the boot for easier riding. Additionally, pressure is uniformly distributed across the back of the boot for comfortable riding. The inner surface of the highback 22 may include resilient pads 42, 44 to increase heel hold, to absorb shock and to further distribute pressure across the boot.

In one embodiment of the invention, an adjustability feature is provided so that the position of the actuator 30 relative to the highback 22 can be adjusted along the longitudinal axis of the boot. In this manner, a single actuator can be adjusted to accommodate boots of different sizes. In the embodiment shown in FIG. 5, the actuator 30, in the form of a heel ring, is mounted to a binding baseplate 46 via a set of four fasteners 48, such as screws. The adjustability feature is provided via a plurality of holes 50 being provided on the heel ring 30 for each screw. However, it should be understood that the adjustability feature can be provided in a number of other ways, such as by providing slots on the heel ring 30, or a plurality of spaced holes in the baseplate 46, rather than the heel ring 30, for receiving each screw 48.

Since the desired amount of forward lean varies according to a rider's individual preferences, the system 20 may include a forward lean adjuster that allows the rider to preselect the forward lean angle that the highback 22 attains when activated into the ride position. In one embodiment as illustrated in FIG. 5, the forward lean adjuster includes an adjustable block 52 that is mounted on the rear of the highback to overlie and engage the actuator 30 in the ride position. The block 52 may be slidably attached to the highback 22 for quick and convenient forward lean adjustment. The forward lean of the highback increases as the block 52 is slid in a downward direction from the top of the highback toward the bottom of the highback. It should be understood, however, that the forward lean may be adjusted using any suitable adjustment means apparent to one of skill. For example, the block 52 and/or the highback 22 may include multiple mounting holes that allow selective positioning of the block on the highback.

Figure 6:
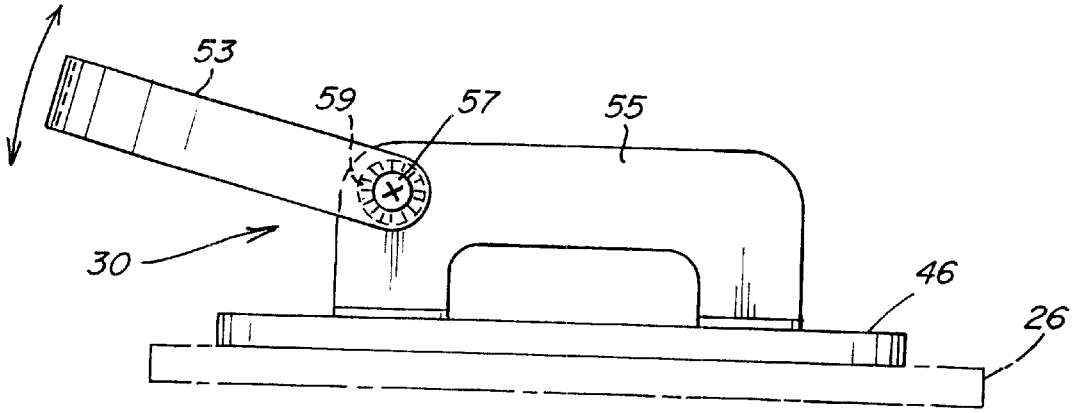
FIG. 6 is a side view of one illustrative embodiment of an adjustable actuator.

Alternatively, the actuator 30, rather than or in addition to the block 52, may be adjustable relative to the highback 22 to establish the forward lean of the highback in the ride position. In one illustrative embodiment shown in FIG. 6, the actuator 30 may include an adjustable heel ring 53 that is rotatably attached to a stationary support 55 using a suitable fastener 57, such as a screw. The support 55 is mounted on the binding baseplate 46 so that the angle of the heel ring 53 may be adjusted relative to the board 26. For example, as the angle of the heel ring 53 increases relative to the board, the amount of highback forward lean increases upon activation. The heel ring 53 and the support 55 may be interlocked to prevent the preselected ring adjustment from shifting when subjected to forces through the highback 22. In one embodiment, the heel ring 53 includes an interlocking feature 59, such as teeth, ribs, splines or the like, that interlocks with a corresponding interlocking feature on the support 55.

Figure 7:
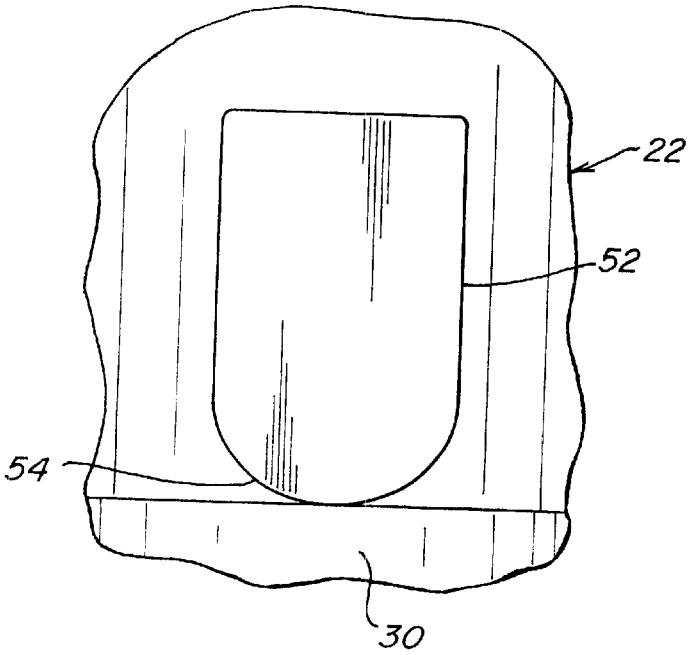
FIG. 7 is a partial rear view of the highback taken along view line 7—7 of FIG. 1 illustrating one embodiment of a highback for facilitating lateral roll.

As described above, many riders find lateral foot roll desirable when riding. To facilitate foot roll, the lower portion of the highback 22 that engages the actuator 30 may be rounded from side-to-side. In one illustrative embodiment shown in FIG. 7, the forward lean block 52 may include a bottom contact surface 54 with an arcuate shape from side-to-side that allows the highback 22 to roll in the lateral side-to-side direction while providing consistent heel side support against the actuator 30. It is to be appreciated that any suitable arrangement apparent to one of skill in the art may be employed to facilitate lateral roll of the highback.

The system may include a restraint for limiting the amount of relative movement between the highback 22 and the boot 28 in the walk mode. For example, the restraint may maintain the highback 22 generally in close proximity to the boot in the walk mode without limiting the flexibility of the boot so that the rider may walk comfortably in the boot. The restraint prevents the highback 22 from falling away from the rear of the boot 28 and interfering with placement of the boot in the binding 24. The restraint also ensures that the highback 22 does not flop around or become dragged along the ground as the rider walks with the highback in the walk mode.

Figure 8:
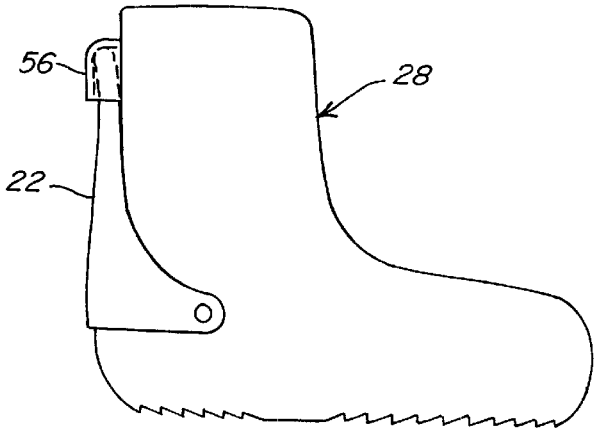
FIG. 8 is a schematic side view of a system incorporating an illustrative embodiment of a highback restraint.
Figure 9:
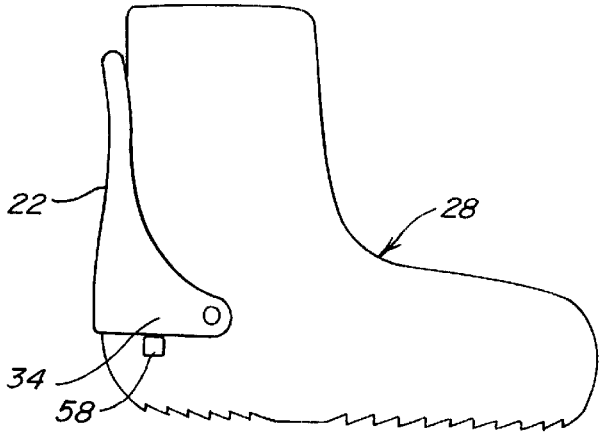
FIG. 9 is a schematic side view of a system incorporating another illustrative embodiment of a highback restraint.
Figure 10:
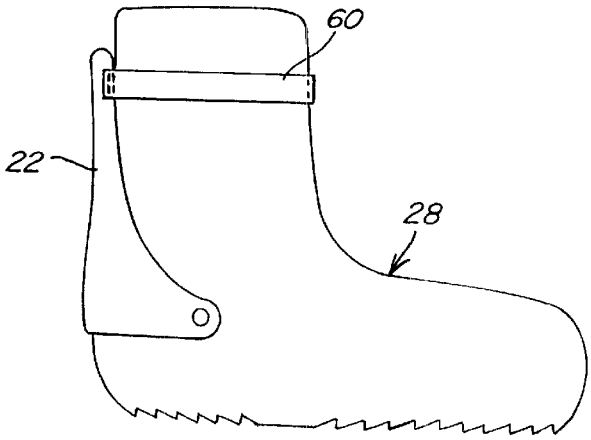
FIG. 10 is a schematic side view of a system incorporating a further illustrative embodiment of a highback restraint.

In one embodiment illustrated in FIG. 8, the restraint may include a downwardly facing pocket 56 along the top rear portion of the boot 28 for receiving the top portion of the highback 22. The pocket 56 is preferably configured to allow sufficient relative movement between the highback 22 and the boot 28 so that the boot may be freely flexed when the system is in the walk mode. It is to be understood, however, that any suitable restraint apparent to one of skill may be implemented to limit movement of the highback 22 away from the rear of the boot 28. For example, as illustrated in FIG. 9, a stop 58 may be provided on the boot, such as below one or both lateral arms 34, to engage a portion of the bottom edge of the highback 22 to limit movement of the highback 22 relative to the boot 28. Alternatively, as illustrated in FIG. 10, an adjustable strap 60 may be attached between the boot 28 and the highback 22 for limiting the amount of relative movement to the length of the strap 60.

As discussed above, the active highback system of the present invention is not limited to any particular binding. However, an illustrative example of a step-in binding 24 suitable for use with the particular implementation of the active highback system 20 shown in FIG. 1 is illustrated in FIG. 5. The binding 24 includes a baseplate 46 and a hold-down disc 62 that is adapted to mount the baseplate 46 to a snowboard 26. The hold-down disc 62 includes holes for receiving a plurality of screws 64 to mount the hold-down disc to the snowboard 26. Mounted to the baseplate 46 is a pair of moveable engagement members 66, each including a pair of spaced apart engagement lobes 68, 70 that are adapted to mate with corresponding recesses 72, 74 provided in the binding interface 40 of the boot 28. Each moveable engagement member 66 further includes a trigger 76 that causes the engagement lobes 68, 70 to move into engagement with the recesses 72, 74 when the binding interface 40 is placed on the baseplate 46. The interface 40 can optionally include a pair of lower recesses 78 adapted to receive the triggers 76. Each moveable engagement member 66 is further coupled to a handle 80 that can be used to move the engagement member from a closed, locked position to an open, released position.

The particular binding 24 shown in FIG. 5 is described in greater detail in U.S. patent application Ser. No. 08/780,721, now U.S. Pat. No. 6,123,354, which is incorporated herein by reference. An alternate binding that can be employed with the particular interface 40 shown in FIG. 5 is described in U.S. patent application Ser. No. 08/655,021 now mU.S. Pat. No. 5,722,680, which is also incorporated herein by reference. The recesses 72, 74 shown in FIG. 5 are described in greater detail in U.S. application Ser. No. 08/584,053 now U.S. Pat. No. 6,126,179, which is also incorporated herein by reference.

In another aspect of the invention, the active highback system may be implemented with a detachable binding interface system for interfacing the boot 28 to a binding 24. As illustrated in one embodiment shown in FIG. 11, the interface 82 includes a body 84 and at least one adjustable strap 86 that is arranged to be disposed across the ankle portion of the boot 28, which is shown in phantom. The strap 86 may include a buckle 87, such as a ratchet-type buckle, to enable adjustment of the strap about the boot. The active highback 22 is movably mounted to the sidewalls 88 of the interface body 84 using a suitable fastener 89 that passes through the lateral arms 34 of the highback. The highback 22 may be activated and deactivated as described above.

The body 84 of the interface 82 may include one or more mating features that are adapted to engage with corresponding engagement members on the binding. In the illustrative embodiment shown in FIG. 11, the body 84 is provided with a pair of recesses 90, 92, similar to those described above, that are configured for engagement with the step-in binding 24 described in connection with the embodiment shown in FIG. 5. It is to be understood, however, that the particular interface features between the binding interface and the binding are exemplary, and that any suitable interface features may be incorporated as would be apparent to one of skill in the art.

Figure 12:
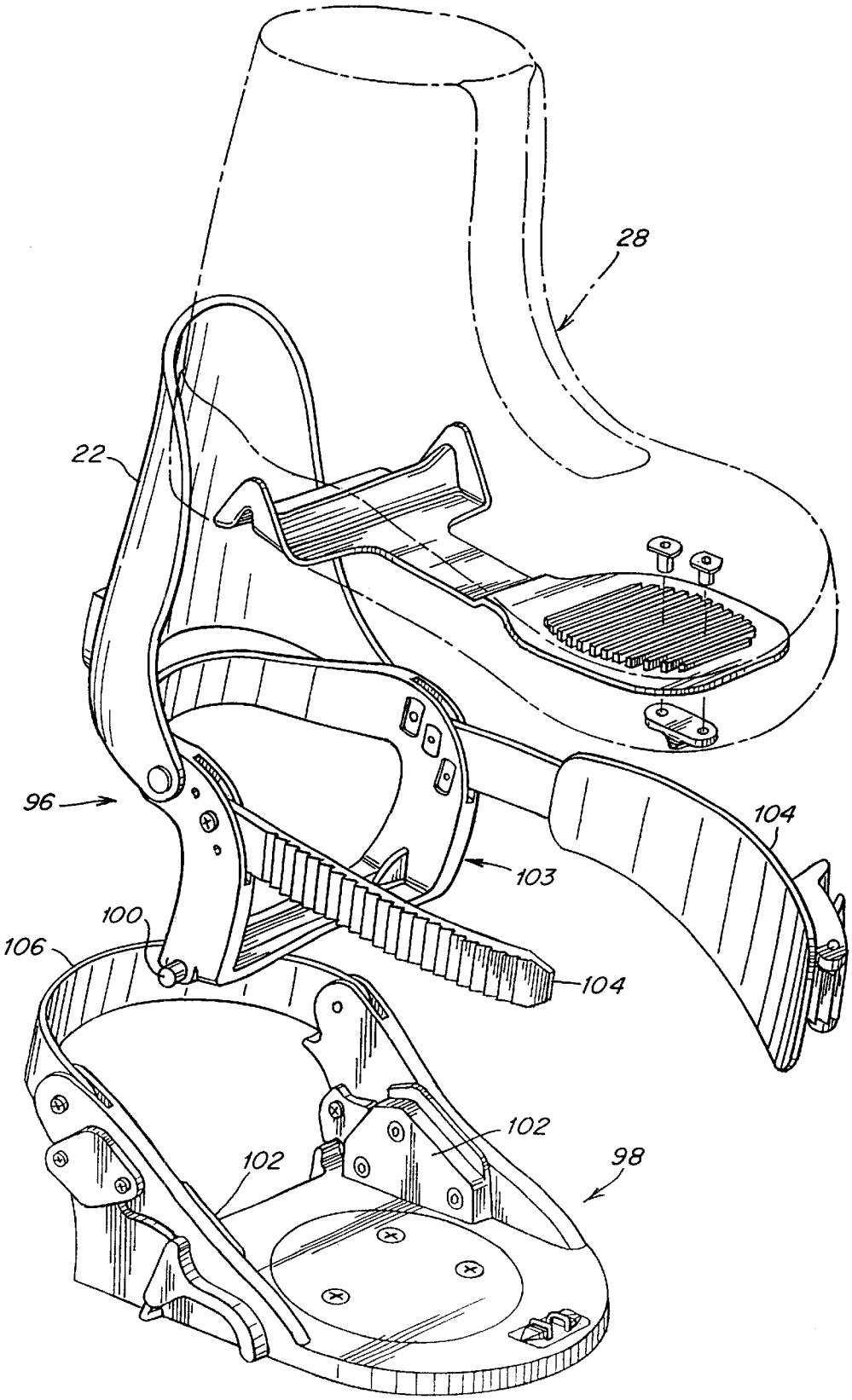
FIG. 12 is a perspective view of the active highback system incorporated with another illustrative embodiment of a detachable binding interface.

FIG. 12 illustrates another embodiment of a detachable binding interface 96 and step-in binding 98 that may incorporate an active highback 22 according to the present invention. The binding interface 96 includes an engagement rod 100 with opposing ends for engaging with a pair of locking mechanisms 102 provided at the rear of the binding. The engagement rod 100 is secured to the boot 28 with an interface body 103 and an adjustable strap 104 that is tightened across the ankle portion of the boot. The highback 22 is movably mounted to the interface body 103 to be activated when the highback 22 engages the binding heel ring 106 and deactivated when the boot 28 is removed from the binding 98, as described above.

Figure 11:
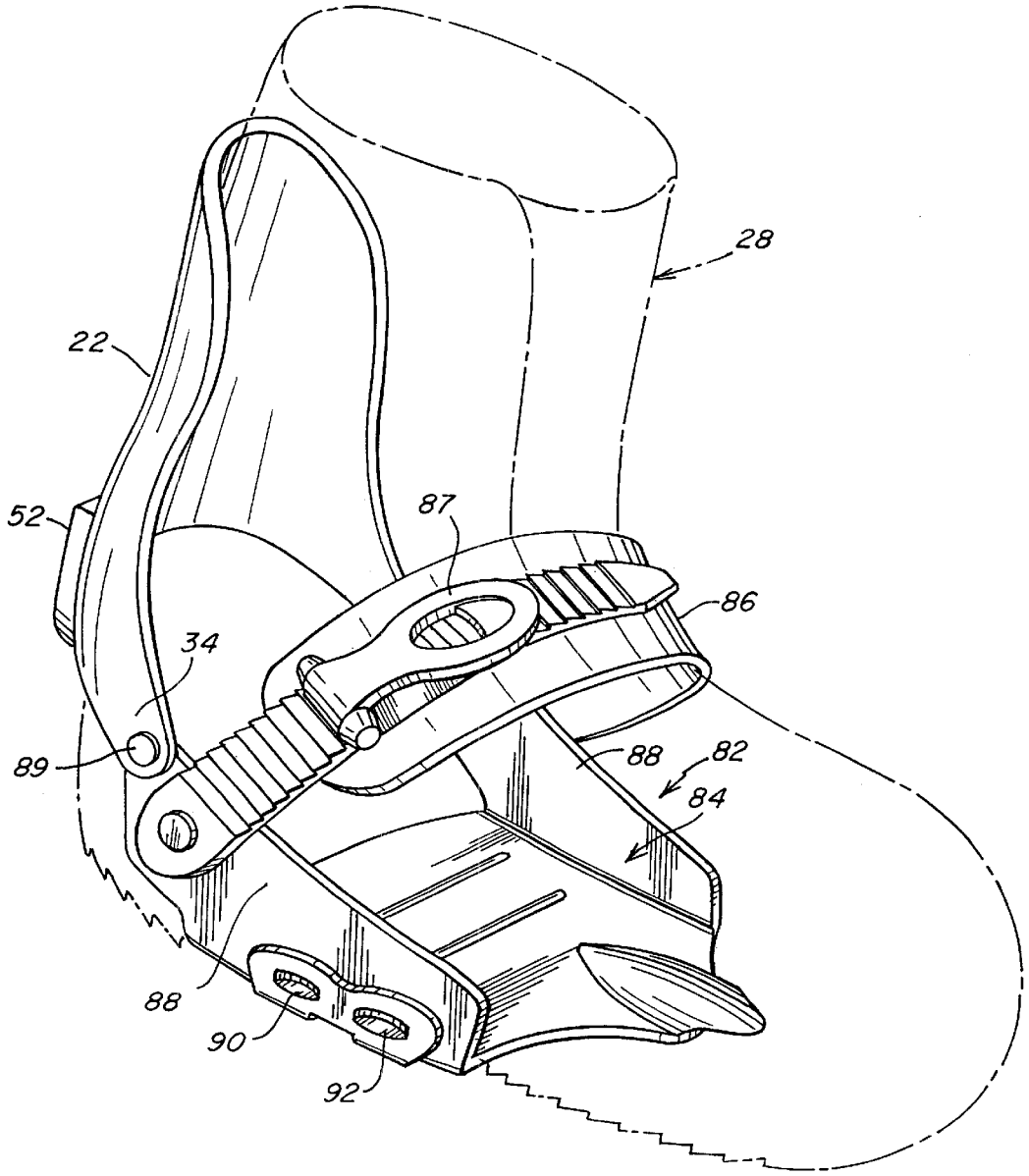
FIG. 11 is a perspective view of the active highback system incorporated with an illustrative embodiment of a detachable binding interface according to another aspect of the invention.

The particular binding interfaces and bindings shown in FIGS. 11 and 12 are described in greater detail in U.S. patent application Ser. No. 09/062,131, which is incorporated herein by reference.

Although described above in connection with several step-in bindings, it should be appreciated that the active highback system of the present invention may be used in conjunction with any suitable type of binding as would be recognized by one of skill in the art. For example, the active highback system may be implemented with a conventional tray binding having no highback on the binding itself. Application of the active highback with a tray binding can advantageously facilitate placement of the boot in the binding, particularly when the rider prefers an extreme forward lean angle. The active highback system allows the rider to exert a large downward force into the binding that facilitates placement of the highback toward the extreme forward lean position in conjunction with easier entry of the boot into the binding.

Figure 13:
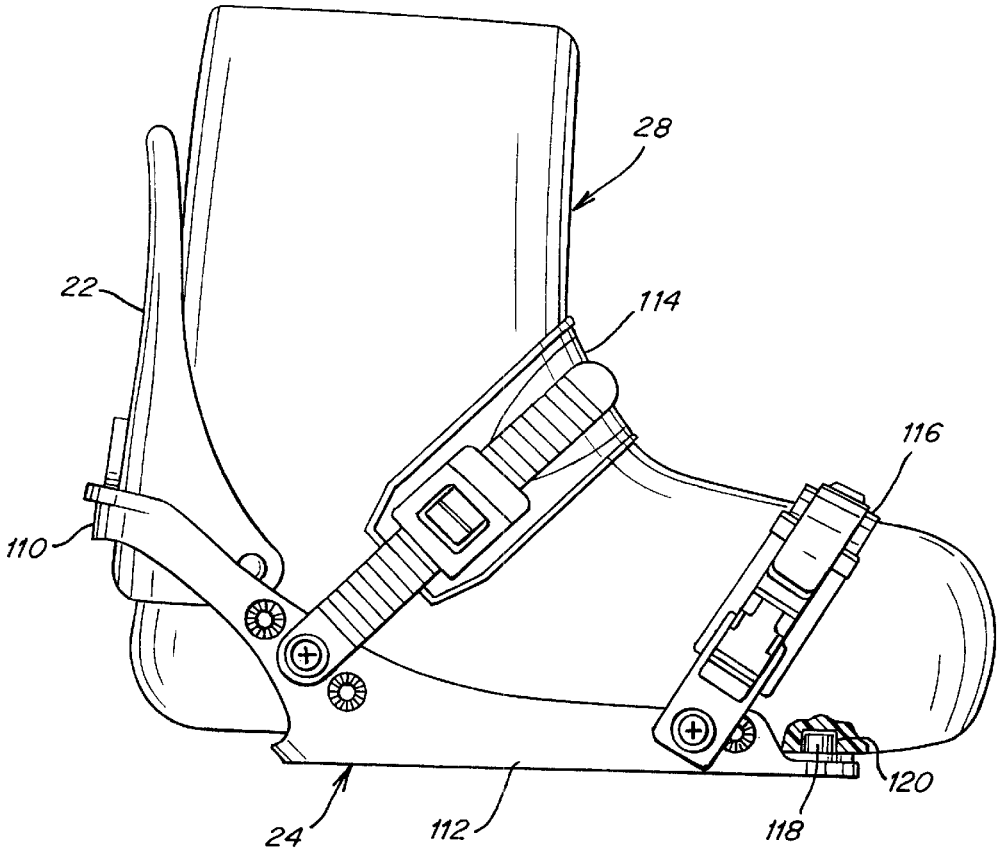
FIG. 13 is a side view of the active highback system incorporated with a tray binding according to another illustrative embodiment of the invention.

An active highback 22 may be mounted to the boot 28, as described above, and configured to engage the heel cup 110 of a conventional tray binding baseplate 112, as shown in FIG. 13. Since the flexible straps 114, 116 of a tray binding allow some forward play, an interlock may be provided between the binding and the boot to minimize the amount of forward boot movement relative to the baseplate to ensure that the highback maintains contact with the heel cup. In one embodiment, the interlock may include an upstanding post 118 mounted to the baseplate 112 that cooperates with a cavity 120 or recess on the boot 28. It should be understood that the system may implement any suitable interlock apparent to one of skill in the art.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A snowboard boot, comprising:

a snowboard boot body including a toe portion, a heel portion and a leg portion, the leg portion being flexible relative to the toe and heel portions in a toe direction and a heel direction; and an active highback supported on the snowboard boot body about the leg portion to provide heel side support, the highback being engagable with a forward lean actuator that is separate from the snowboard boot to automatically activate the highback into a ride position at a predetermined forward lean, where the highback is tilted toward the toe portion of the boot to prevent movement of the leg portion in the heel direction beyond the predetermined forward lean so that leg movement in the heel direction is transmitted through the highback into a snowboard, the highback being deactivated from the ride position to assume a walk mode when the highback is not engaged with the forward lean actuator, where the highback is unrestrained so that the leg portion of the boot is permitted to flex in the heel direction beyond the predetermined forward lean.

2. The snowboard boot recited in claim 1, wherein the highback is mountable directly to the snowboard boot body.

3. The snowboard boot recited in claim 1, further comprising a binding interface that is constructed and arranged to interface the snowboard boot body with a snowboard binding, wherein the highback is mounted to the binding interface.

4. The snowboard boot recited in claim 3, wherein the binding interface is detachable from the snowboard boot body.

5. The snowboard boot recited in claim 4, wherein the binding interface includes at least one strap to secure the binding interface to the snowboard boot body.

6. The snowboard boot recited in claim 1, further comprising a forward lean adjuster that is constructed and arranged to establish the predetermined forward lean of the highback in the ride position.

7. The snowboard boot recited in claim 6, wherein the forward lean adjuster is mounted to the highback.

8. The snowboard boot recited in claim 7, wherein the forward lean adjuster includes an arcuate surface that is engagable with the forward lean actuator in the ride position to facilitate lateral roll between the highback and the forward lean actuator.

9. The snowboard boot recited in claim 1, wherein the highback includes an arcuate surface that is engagable with the forward lean actuator in the ride position to facilitate lateral roll between the highback and the forward lean actuator.

10. The snowboard boot recited in claim 1, further comprising a restraint that is constructed and arranged to limit relative movement between the highback and the snowboard boot body in the walk mode without limiting the flexibility of the leg portion in the heel direction.

11. The snowboard boot recited in claim 10, wherein the restraint includes a downwardly facing pocket disposed at an upper portion of the snowboard boot body, the pocket being adapted to receive an upper portion of the highback therein.

12. The snowboard boot recited in claim 10, wherein the restraint includes a stop that is disposed on the snowboard boot body to engage a portion of the highback.

13. The snowboard boot recited in claim 12, wherein the stop is disposed on a lower portion of the snowboard boot body to engage a bottom portion of the highback.

14. An apparatus comprising:

a forward lean actuator that is constructed and arranged to be mounted on a gliding board; and a separate boot-mountable highback that is constructed and arranged to be activated by the forward lean actuator into a ride position at a predetermined forward lean, where the highback is tilted toward a toe portion of the boot and prevented from movement in a heel direction beyond the predetermined forward lean so that leg movement in the heel direction is transmitted through the highback into the gliding board, the highback to be deactivated from the ride position to assume a walk mode when the boot is detached from the gliding board, where the highback is unrestrained so that the boot is permitted to flex in the heel direction beyond the predetermined forward lean.

15. The apparatus recited in claim 14, wherein the highback engages the forward lean actuator when the boot is placed on the gliding board to drive the highback into the ride position, and the highback assumes the walk mode when the highback is disengaged from the forward lean actuator.

16. The apparatus recited in claim 14, wherein the highback is mountable directly to the boot.

17. The apparatus recited in claim 14, further comprising a binding interface that is constructed and arranged to interface the boot with a binding, wherein the highback is mounted to the binding interface.

18. The apparatus recited in claim 17, wherein the binding interface is detachable from the boot.

19. The apparatus recited in claim 18, wherein the binding interface includes at least one strap to secure the binding interface to the boot.

20. The apparatus recited in claim 14, further comprising a forward lean adjuster that is constructed and arranged to establish the forward lean of the highback in the ride position.

21. The apparatus recited in claim 20, wherein the forward lean adjuster is mounted to the highback.

22. The apparatus recited in claim 21, wherein the forward lean adjuster includes an arcuate surface that contacts the forward lean actuator in the ride position to facilitate lateral roll between the highback and the forward lean actuator.

23. The apparatus recited in claim 14, wherein the highback includes an arcuate surface that contacts the forward lean actuator in the ride position to facilitate lateral roll between the highback and the forward lean actuator.

24. The apparatus recited in claim 14, wherein the forward lean actuator is adjustable relative to the highback.

25. The apparatus recited in claim 24, wherein the forward lean actuator is adjustable to establish the forward lean of the highback in the ride position.

26. The apparatus recited in claim 14, further comprising a restraint that is constructed and arranged to limit relative movement between the highback and the boot in the walk mode without limiting the flexibility of the boot in the heel direction.

27. The apparatus recited in claim 26, wherein the restraint includes a downwardly facing pocket disposed at an upper portion of the boot, the pocket being adapted to receive an upper portion of the highback therein.

28. The apparatus recited in claim 26, wherein the restraint includes a stop that is disposed on the boot to engage a portion of the highback.

29. The apparatus recited in claim 28, wherein the stop is disposed on a lower portion of the boot to engage a bottom portion of the highback.

30. The apparatus recited in claim 14, further comprising a binding that is constructed and arranged to secure the boot to the gliding board, the forward lean actuator being mounted to the binding.

31. The apparatus recited in claim 30, wherein the binding includes a baseplate and a heel ring mounted to the baseplate, the forward lean actuator including the heel ring.

32. The apparatus recited in claim 31, wherein the heel ring is adjustably mounted to the baseplate.

33. The apparatus recited in claim 32, wherein the heel ring is rotatable relative to the baseplate to adjust the forward lean of the highback in the ride position.

34. The apparatus recited in claim 30, wherein the binding is a step-in binding.

35. The apparatus recited in claim 30, wherein the binding is a snowboard binding and the boot is a snowboard boot.

36. The apparatus recited in claim 35, wherein the snowboard binding is a tray binding that includes at least one strap that extends across the binding to secure the snowboard boot.

37. The apparatus recited in claim 14, in combination with the boot, the highback being mounted to the boot.

38. The apparatus recited in claim 37, wherein the boot is a snowboard boot.

39. The apparatus recited in claim 37, further in combination with the gliding board.

40. The apparatus recited in claim 39, wherein the boot is a snowboard boot and the gliding board is a snowboard.

41. An apparatus comprising:

a snowboard boot;

a highback mounted to the snowboard boot;

a snowboard binding that is constructed and arranged to secure the snowboard boot to a snowboard; and a forward lean actuator mounted to the snowboard binding, the highback being activated by the forward lean actuator into a ride position at a predetermined forward lean when the snowboard boot is secured in the snowboard binding, where the highback is tilted toward a toe portion of the boot and prevented from movement in a heel direction beyond the predetermined forward lean so that leg movement in the heel direction is transmitted through the highback into the snowboard, the highback to be deactivated from the ride position to assume a walk mode when the boot is detached from the binding, where the highback is unrestrained so that the boot is permitted to flex in the heel direction beyond the predetermined forward lean.

42. The apparatus recited in claim 41, wherein the highback is rotatably mounted to the snowboard boot.

43. The apparatus recited in claim 41, wherein the highback is detachable from the snowboard boot.

44. The apparatus recited in claim 43, further comprising a detachable binding interface that is constructed and arranged to interface the snowboard boot with the snowboard binding, wherein the highback is mounted to the detachable binding interface.

45. The apparatus recited in claim 44, wherein the binding interface includes at least one strap to secure the binding interface to the snowboard boot.

46. The apparatus recited in claim 41, wherein the highback engages the forward lean actuator when the snowboard boot is placed on the snowboard to drive the highback into the ride position, and the highback assumes the walk mode when the highback is disengaged from the forward lean actuator.

47. The apparatus recited in claim 46, wherein the snowboard binding includes a baseplate and a heel ring mounted to the baseplate, the forward lean actuator including the heel ring.

48. The apparatus recited in claim 47, wherein the heel ring is adjustably mounted to the baseplate.

49. The apparatus recited in claim 48, wherein the heel ring is rotatable relative to the baseplate to adjust the forward lean of the highback in the ride position.

50. The apparatus recited in claim 41, further comprising a forward lean adjuster that is adjustably mounted to the highback to establish the forward lean of the highback in the ride position.

51. The apparatus recited in claim 41, further comprising a restraint that is constructed and arranged to limit relative movement between the highback and the snowboard boot in the walk mode without limiting the flexibility of the boot in the heel direction.

52. The apparatus recited in claim 41, wherein the snowboard binding is a step-in binding.

53. The apparatus recited in claim 41, wherein the snowboard binding is a tray binding that includes at least one strap that extends across the binding to secure the snowboard boot.

54. The apparatus recited in claim 41, in combination with the snowboard.

55. A method of activating a highback between a ride position and a walk mode, the method comprising steps of:

(a) providing a boot with a highback;

(b) providing a forward lean actuator on a gliding board separate from the boot; and (c) activating the highback with the forward lean actuator into the ride position at a predetermined forward lean by placing the boot on the gliding board, where the highback is tilted toward a toe portion of the boot and prevented from movement in a heel direction beyond the predetermined forward lean so that leg movement in the heel direction is transmitted through the highback into the gliding board.

56. The method recited in claim 55, wherein step (c) includes engaging the forward lean actuator with the highback to drive the highback into the ride position.

57. The method recited in claim 56, further comprising step (d) of deactivating the highback from the ride position to assume the walk mode by disengaging the highback from the forward lean actuator, where the highback is unrestrained so that the boot is permitted to flex in the heel direction beyond the predetermined forward lean.

58. The method recited in claim 57, further comprising step (e) of limiting movement of the highback away from the boot in the walk mode without limiting the flexibility of the boot in the heel direction.

59. The method recited in claim 55, wherein step (a) includes attaching a binding interface to the boot for interfacing the boot with a binding, the highback being mounted to the binding interface.

60. The method recited in claim 55, further comprising step (d) of adjusting the amount of forward lean attained by the highback in the ride position.

61. The method recited in claim 60, wherein step (d) includes adjusting the forward lean actuator.

62. The method recited in claim 60, wherein step (d) includes adjusting a forward lean adjuster provided on the highback.

63. The method recited in claim 55, wherein step (c) includes securing the boot on the gliding board with a binding.

* * * * *